US008708753B2

(12) United States Patent
Wang et al.

(10) Patent No.: US 8,708,753 B2
(45) Date of Patent: Apr. 29, 2014

(54) ELECTRICAL CONNECTOR WITH DIFFERENT CONTACTS SHARING A SAME SOLDERING LEG

(75) Inventors: Zhen-Sheng Wang, Kunshan (CN); Andrew Cheng, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 63 days.

(21) Appl. No.: 13/562,320

(22) Filed: Jul. 31, 2012

(65) Prior Publication Data

US 2013/0040499 A1 Feb. 14, 2013

(30) Foreign Application Priority Data

Aug. 10, 2011 (CN) ..... 2011 2 0289137

(51) Int. Cl.
*H01R 24/00* (2011.01)

(52) U.S. Cl.
USPC ..... 439/660

(58) Field of Classification Search
USPC ..... 439/660, 79, 404, 493
See application file for complete search history.

(56) References Cited

U.S. PATENT DOCUMENTS 3,643,201 A * 2/1972 Harwood ..... 439/65
5,194,010 A * 3/1993 Dambach et al. ..... 439/79
5,372,512 A * 12/1994 Wilson et al. ..... 439/67
5,432,456 A * 7/1995 Kelley ..... 324/538
5,453,016 A * 9/1995 Clark et al. ..... 439/79
5,504,989 A * 4/1996 Clark et al. ..... 29/747
5,620,331 A * 4/1997 Los et al. ..... 439/404
5,696,027 A * 12/1997 Crane et al. ..... 438/612
5,820,392 A * 10/1998 Lin et al. ..... 439/108
5,827,076 A * 10/1998 Chen ..... 439/79
5,892,280 A * 4/1999 Crane et al. ..... 257/738
6,630,925 B1 * 10/2003 Ostergård et al. ..... 345/168
7,128,582 B2 * 10/2006 Fang et al. ..... 439/79
7,232,346 B2 * 6/2007 Hu et al. ..... 439/660
7,517,253 B1 * 4/2009 Chiang ..... 439/660
7,559,805 B1 * 7/2009 Yi et al. ..... 439/660
7,654,871 B2 * 2/2010 Yi et al. ..... 439/660
7,682,200 B2 * 3/2010 Zheng et al. ..... 439/660
7,682,203 B1 * 3/2010 Pharney et al. ..... 439/676
7,690,944 B2 * 4/2010 Matsumura et al. ..... 439/578
7,758,385 B2 * 7/2010 Davis et al. ..... 439/626
7,837,510 B1 * 11/2010 Hung et al. ..... 439/660
7,878,827 B2 * 2/2011 Yao et al. ..... 439/181
7,914,346 B2 * 3/2011 Pharney et al. ..... 439/676

(Continued)

FOREIGN PATENT DOCUMENTS

TW M372016 1/2010

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector includes an insulative housing defining a tongue plate, a first set of contacts disposed upon the tongue plate, a second set of contacts disposed upon the tongue plate, and an inner PCB retained in the housing. The inner PCB defines at least one input connecting portion, at least one output connecting portion electrically connected with the at least one input connecting portion, and a first soldering leg connecting with the at least one output connecting portion. At least one of the first set of contacts connect with the first soldering leg, and at least one of the second set of contacts connect with the at least one input connecting portion to share the first soldering leg for mounting onto the mother PCB.

20 Claims, 7 Drawing Sheets

(56) References Cited

U.S. PATENT DOCUMENTS

| | | | | |
|---|---|---|---|---|
| 8,187,039 | B2 * | 5/2012 | Tsai | 439/660 |
| 8,202,119 | B2 * | 6/2012 | Zhang | 439/607.23 |
| 8,398,416 | B2 * | 3/2013 | Tseng | 439/188 |
| 8,512,071 | B2 * | 8/2013 | Tseng et al. | 439/493 |
| 2006/0025015 | A1 * | 2/2006 | Hu et al. | 439/607 |
| 2009/0042421 | A1 * | 2/2009 | Zheng et al. | 439/83 |

* cited by examiner

ELECTRICAL CONNECTOR WITH DIFFERENT CONTACTS SHARING A SAME SOLDERING LEG

FIELD OF THE INVENTION

The present invention relates generally to an electrical connector, and more particularly to an electrical connector having different contacts sharing a same soldering leg for reducing the exhaustion of the space of a mother printed circuit board (PCB).

DESCRIPTION OF THE RELATED ART

Taiwan Patent No. M372016 issued to Chen on Jan. 1, 2010 discloses an electrical connector mounted upon a mother printed circuit board (PCB). The electrical connector includes an insulative housing having a mating plate, a plurality of contacts retained in the housing, a metal shell covering the housing, an inner printed circuit board (PCB) assembled to the housing, and a plurality of soldering legs connecting with the inner PCB. The inner PCB defines a plurality of connecting points corresponding to the contacts, and a plurality of traces respectively electrically connected with the corresponding connecting points. The contacts each defines a contacting portion disposed upon the mating plate and a connecting leg electrically connecting with one of the connecting points, and the soldering legs each electrically connect with one of the traces so that each contact is electrically connected to a soldering leg for connecting with the mother PCB through the inner PCB.

However, in recent years, electrical connectors is provided with more and more contacts for meeting highly data transmission rates requirement, and the large numbers of contacts each corresponds to a soldering leg may cause the electrical connector has too many soldering legs, which may exhaust a lot of space of the mother PCB and weaken the rigidity of the mother PCB. Hence, an improved electrical connector having less soldering legs is necessary and in which the exhaustion of the space of the mother PCB is considerably reduced.

SUMMARY OF THE INVENTION

Accordingly, an object of the present invention is to provide an electrical connector having different contacts sharing a same soldering leg for reducing the exhaustion of the space of a mother PCB.

In order to achieve the object set forth, an electrical connector includes an insulative housing defining a base portion and a tongue plate forwardly extending into a mating cavity from the base member in a mating direction, first and second sets of contacts retained in the housing, and an inner PCB retained in the housing. The tongue plate defines opposite first and second mating faces in a vertical direction perpendicular to said mating direction, and the first sets of contacts each defines a first contacting section disposed upon the first mating face, the second set of contacts each defines a second contacting section disposed upon the second mating face. The inner PCB defines at least one input connecting portion, at least one output connecting portion electrically connected with the at least one input connecting portion, and a first soldering leg connecting with the at least one output connecting portion. At least one contact of the first set of contacts connects with the first soldering leg, and at least one contact of the second set of contacts connects with the at least one input connecting portion so that the at least one contact of the first set of contacts and the at least one contact of the second set of contacts share the first soldering leg for mounting onto the mother PCB.

Other objects, advantages and novel features of the invention will become more apparent from the following detailed description of the present embodiment when taken in conjunction with the accompanying drawings.

DETAILED DESCRIPTION OF THE INVENTION

Figure 1:
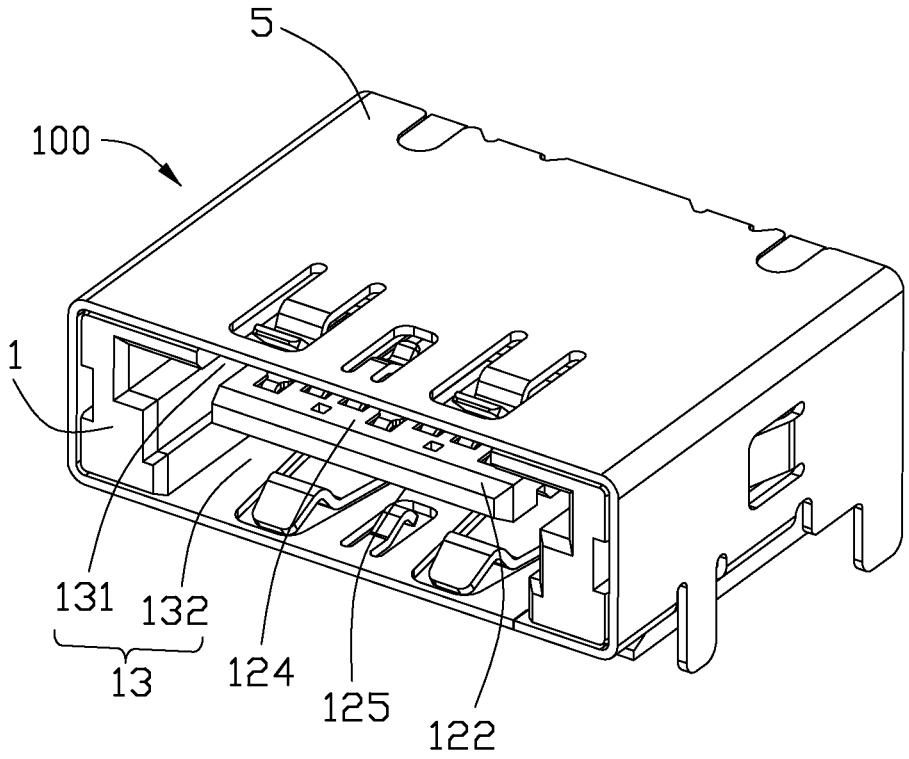
FIG. 1 is an assembled, perspective view of an electrical connector in accordance with the present invention.

Reference will now be made to the drawing figures to describe a preferred embodiment of the present invention in detail.

Figure 2:
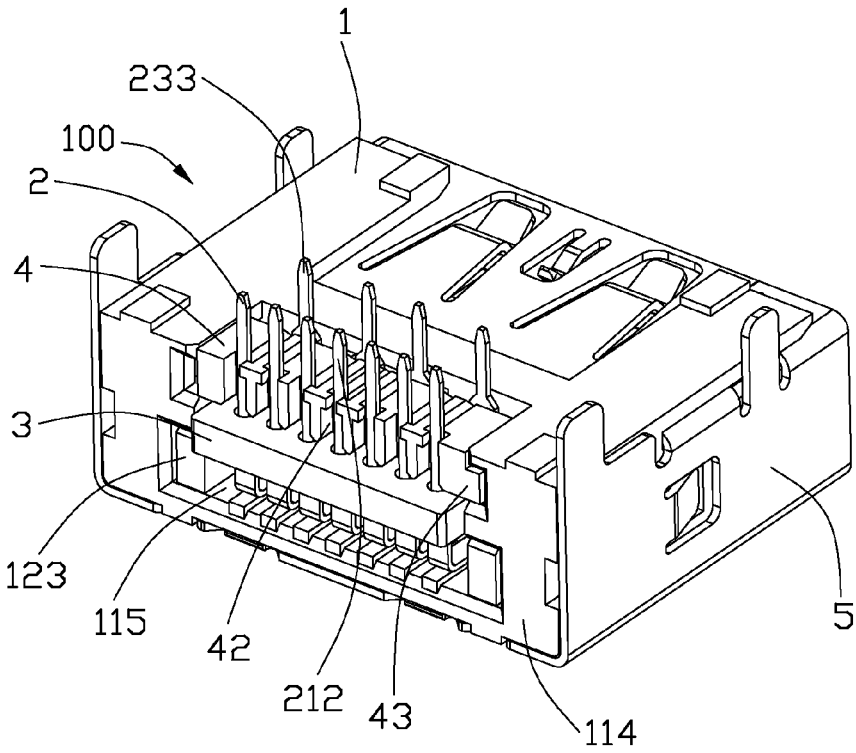
FIG. 2 is another perspective view of the electrical connector shown in FIG. 1.
Figure 3:
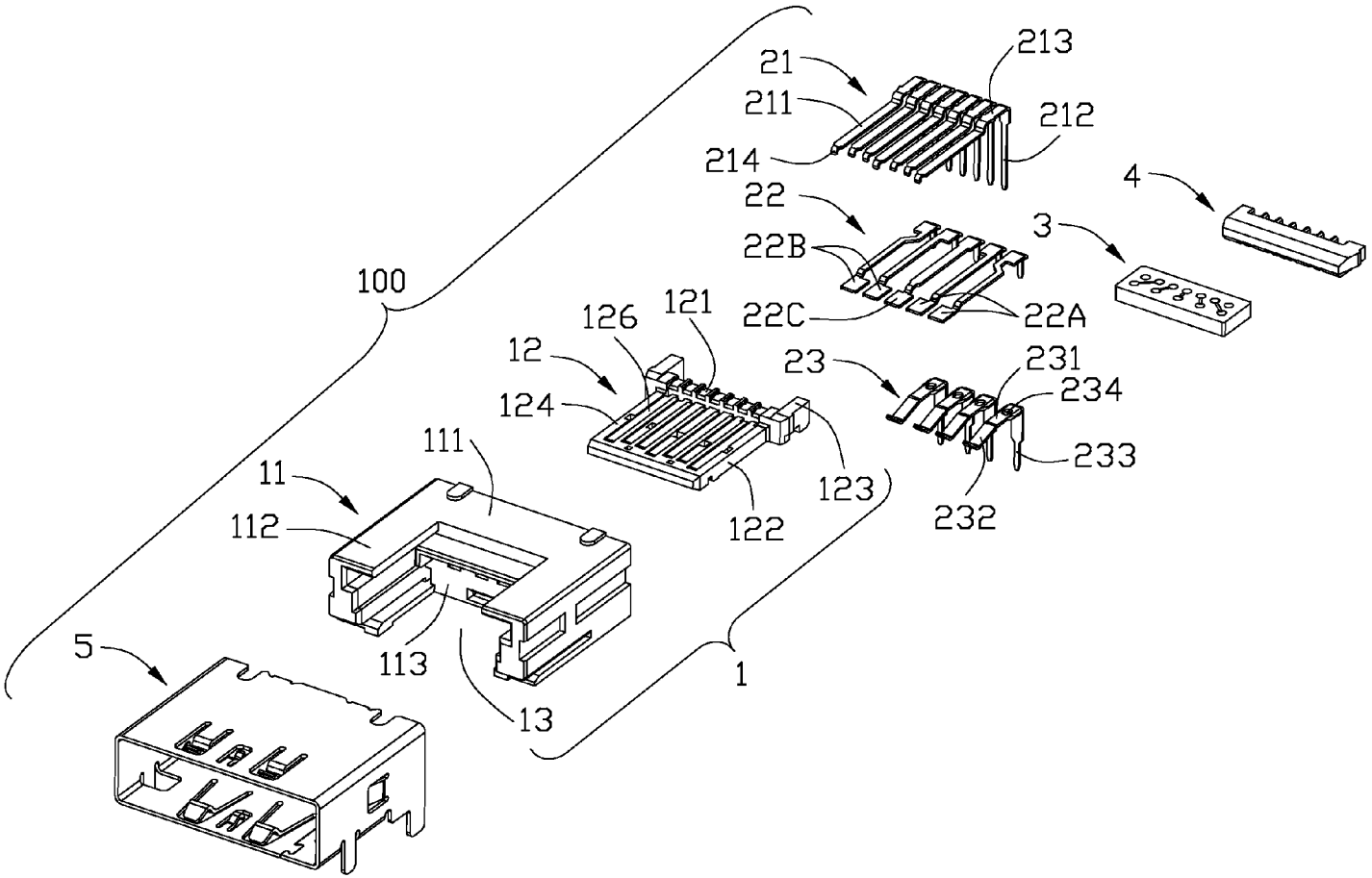
FIG. 3 is an exploded view of the electrical connector shown in FIG. 1.
Figure 4:
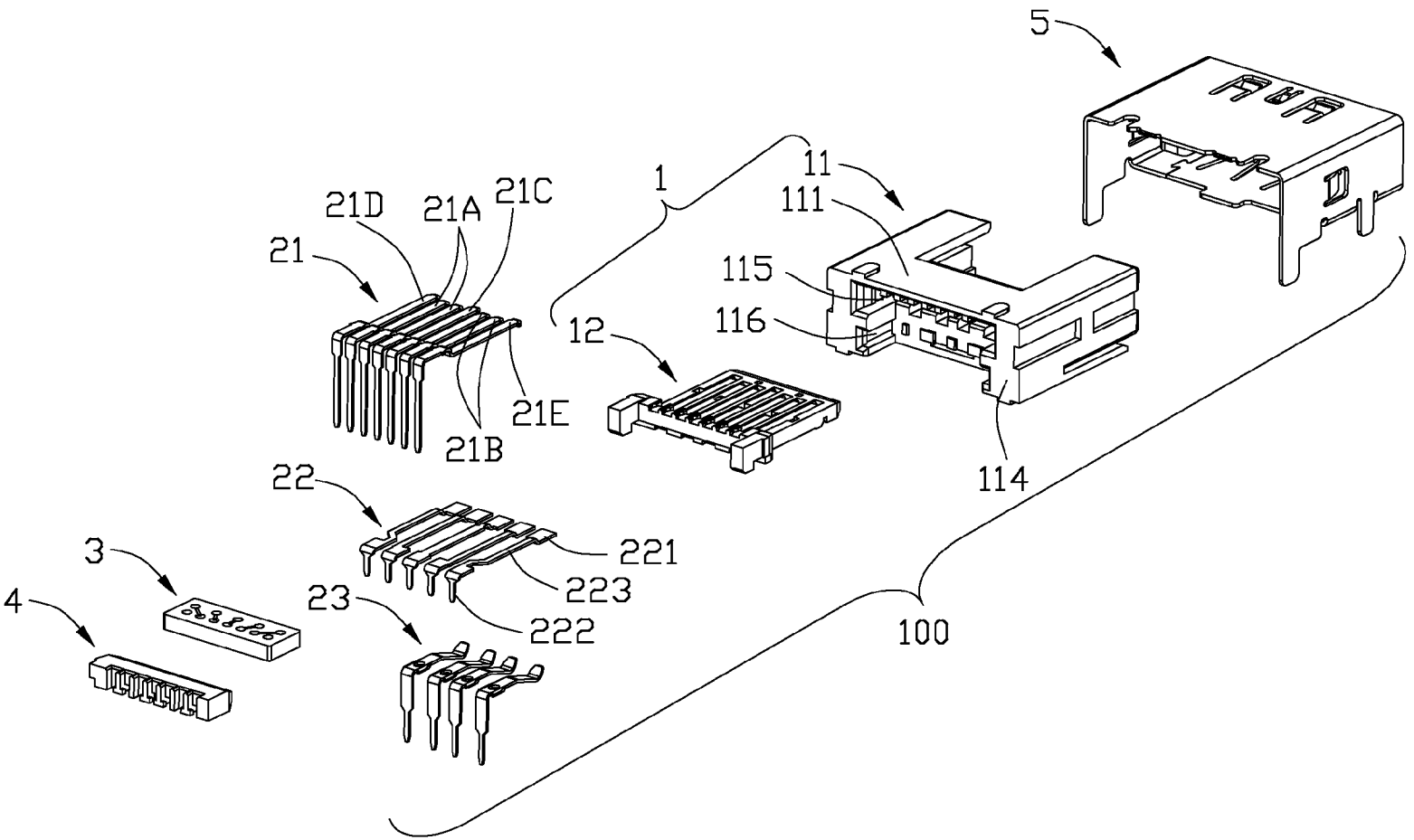
FIG. 4 is another exploded view of the electrical connector shown in FIG. 3.

Referring to FIG. 1 and FIG. 2, an electrical connector 100 to be mounted onto a mother printed circuit board (PCB) mainly includes an insulative housing 1, a plurality of contacts retained in the housing 1, an inner PCB 3 retained to the housing 1, a spacer 4 and a metal shell 5 covering the housing 1.

Referring to FIGS. 3 to 6, the housing 1 defines a base member 11 and a tongue member 12 assembled to the base member 11. The base member 11 defines a base portion 111 and two side arms 112 disposed at two opposite sides of the base portion 111, the base portion 111 defines opposite front face 113 and rear face 114, and a mating cavity 13 is defined between the front face 113 and the two side arms 112. The base portion 111 defines a fixing slot 115 forwardly recessed from the rear face 114 and a retaining slot 116 disposed under the fixing slot 115. The fixing slot 115 further runs through the front face 113 to communicate with the mating cavity 13. The tongue member 12 defines a retaining portion 121 and a tongue plate 122 forwardly extending from the retaining portion 121, the retaining portion 121 defines a pair of flexible latching arms 123 respectively extending rearwards from two opposite sides of the retaining portion 121. The tongue plate 122 defines opposite top face 124 and bottom face 125, and the top face 124 defines a plurality of first receiving grooves 126 arranged in a transverse direction perpendicular to a front-to-rear direction/mating direction, the bottom face 125 defines a plurality of second receiving grooves 127 arranged in the transverse direction and a plurality of receiving portions 128 disposed in front of the second receiving grooves 127. Each second receiving groove 127 defines a fixing post 129 downwardly projecting beyond the bottom face 125 at a rear portion thereof.

The plurality of contacts are grouped into a first set of contacts 21, totally seven External Serial Advanced Technology Attachment (SATA) connector contacts are included, a second set of contacts 22, totally five contacts are included, and a third set of contacts 23, totally four Universal Serial Bus (USB) 2.0 connector contacts are included. The first set of contacts 21 includes two first pairs of differential pairs 21A, 21B for signal transmission and three grounding contacts 21C, 21D, 21E located at two opposite sides of the differential pairs 21A, 21B. The first grounding contact 21C is disposed between the two differential pairs 21A, 21B, and the second and third grounding contact 21D, 21E are disposed at two outmost sides thereof. Similarly, the second set of contacts 22 includes two second pairs of differential pairs 22A, 22B for signal transmission and a fourth grounding contact 22C disposed between the two second differential pairs 22A, 22B. The second set of contacts 22 cooperating with the third set of contacts 23 are the USB 3.0 connector contacts.

The first set of contacts 21 each includes a first blade contacting section 211, a first soldering leg 212 for connecting with the mother PCB, and a first retention section 213 connecting with the first contacting section 211 and the first soldering leg 212. The first set of contacts 21 are downwardly assembled to the tongue member 12 with the first contacting sections 211 received in the first receiving grooves 126 and exposed upon the top face 124, the first soldering legs 212 are disposed between the two latching arms 123. Each first contacting section 211 defines a locking portion 214 at a front end thereof for locking into the tongue plate 122 to prevent the front end of the first contacting section 211 from warping.

The second set of contacts 22 each defines a second blade contacting section 221, a connecting section 222, and a second retention section 223 connecting the second contacting section 221 with the connecting section 222. In this embodiment, the second set of contacts 22 are embedded within the tongue member 12 optimally via an insert molding procedure with the second contacting sections 221 received in the corresponding receiving portions 128 and exposed upon the bottom face 125.

The third set of contacts 23 each defines a fixing portion 231, a resilient arm 232 forwardly extending from the fixing portion 231, and a soldering section 233 bending downwardly from the fixing portion 231. Each fixing portion 231 defines a retaining hole 234 at a rear portion thereof. The third set of contacts 23 are upwardly assembled to the second receiving grooves 127 with the fixing posts 129 running through the corresponding retaining holes 234 to retain the third set of contacts 23 to the tongue member 12. The resilient arms 232 are received in the second receiving grooves 127 and exposed upon the bottom face 125. The second set of contacts 22 are disposed between the first and third set of contacts 21, 23, and the second contacting sections 221 and the resilient arms 232 are exposed upon the bottom face 125.

Figure 5:
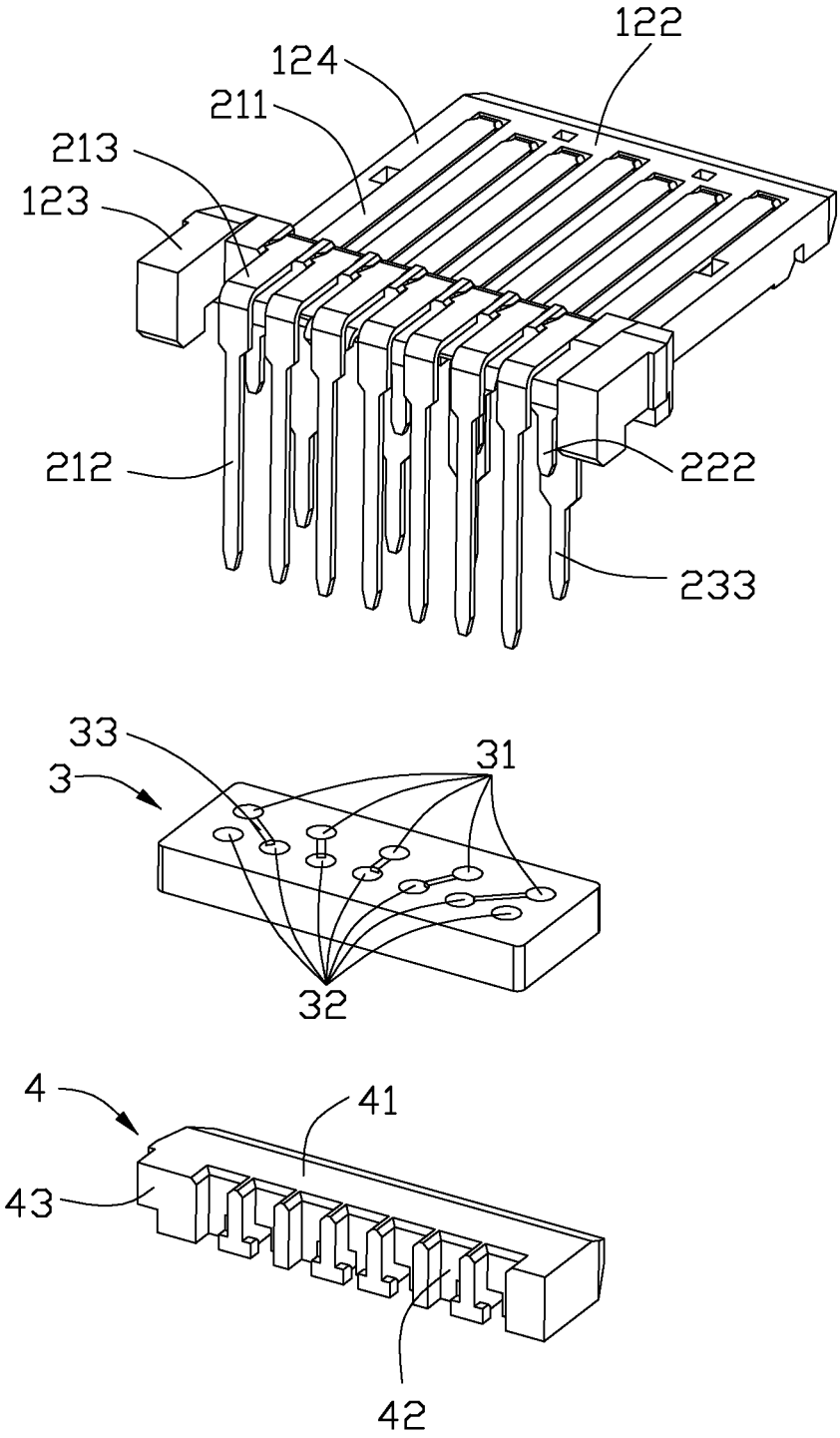
FIG. 5 is a partly exploded view of the electrical connector, showing a second housing assembled with first and second contacts and separated from a inner PCB and a spacer.
Figure 6:
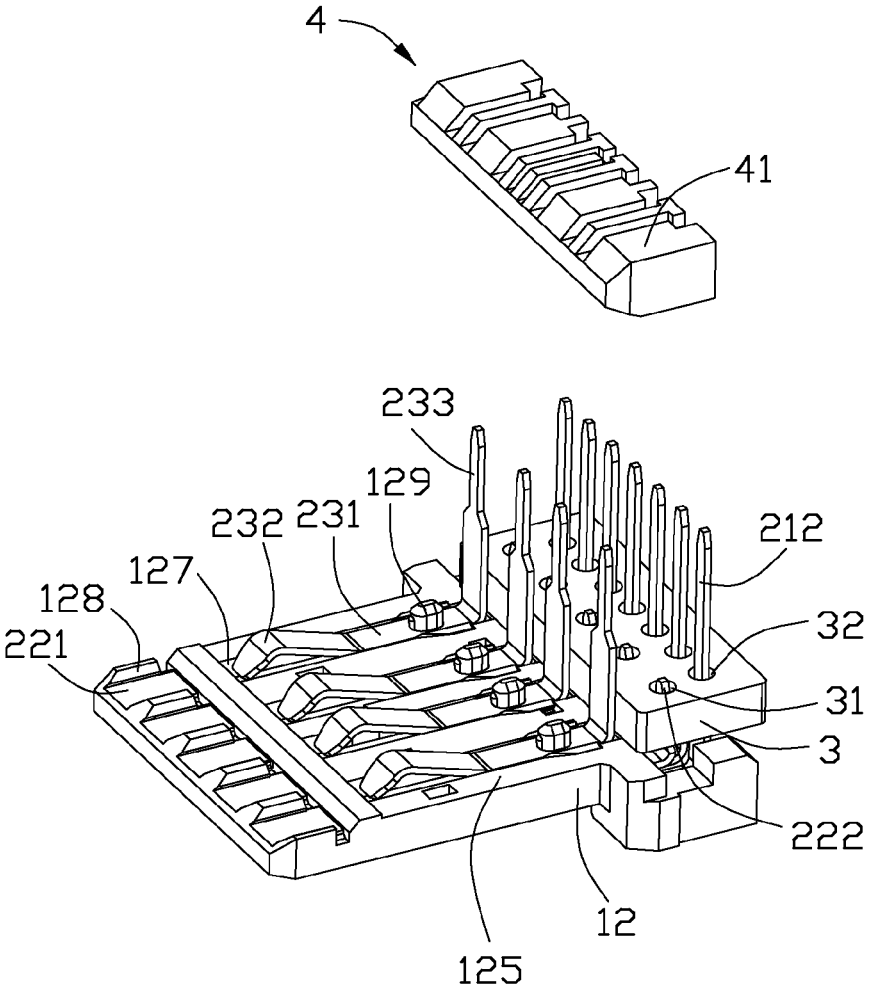
FIG. 6 is another partly exploded view of the electrical connector shown in FIG. 5, showing the inner PCB assembled to the second housing.
Figure 7:
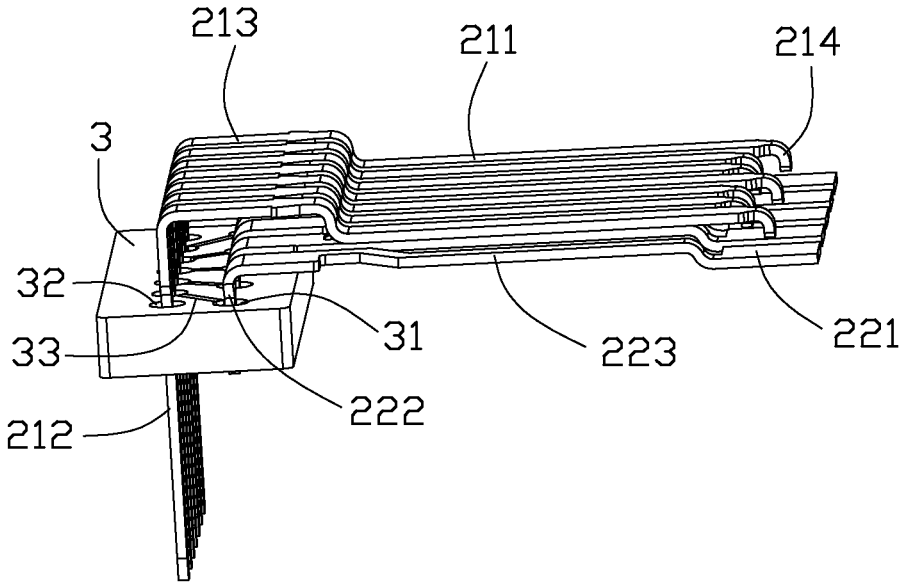
FIG. 7 is a perspective view of the first and second contacts connected with the inner PCB.

Referring to FIGS. 2, 5 and 7, the inner PCB 3 defines five input connecting portions 31 arranged in a first row in a transverse direction and seven output connecting portions 32 arranged in a second row parallel to the first row. The five input connecting portions 31 are respectively electrically connected with five output connecting portions 32 by five connecting lines 33. The inner PCB 3 is upwardly assembled to the tongue member 12 with the seven first soldering legs 212 connecting with the seven output connecting portions 32, and the five connecting sections 222 connecting with the five input connecting portions 31, so that the five connecting sections 222 are respectively electrically connected with the five first soldering legs 212 bending from the two first pairs of differential pairs 21A, 21B and the first grounding contact 21C of the first set of contacts 21. On other wards, the second set of contacts 22 share the first soldering legs 212 of the two first pairs of differential pairs 21A, 21B and the first grounding contact 21C of the first set of contacts 21, which can reduce the number of the soldering legs of the electrical connector 100 for reducing the exhaustion of the space of the mother PCB. The soldering sections 233 are disposed in front of the inner PCB 3. The spacer 4 defines a main portion 41 and seven restricting slots 42 running through the main portion 41 in a vertical direction perpendicular to the mating direction at a rear portion thereof. The main portion 41 defines a blocking portion 43 projecting from a side portion thereof. The spacer 4 is upwardly assembled to the tongue member 12 until abutting against the inner PCB 3, and the first soldering legs 212 run through the restricting slots 42 and restricted therein. The soldering sections 233 are disposed in front of the inner PCB 3.

Referring to FIGS. 1, 2, 4 and 6, the tongue member 12 retaining the three sets of contacts 21, 22, 23, the inner PCB 3 and the spacer 4 is assembled to the base member 11 from the rear face 114 of the base portion 111. The retaining portion 121 of the tongue member 12 is retained in the fixing slot 115 by the pair of flexible latching arms 123 oppositely deflected to engage with the fixing slot 115, and the tongue plate 122 forwardly extend into the mating cavity 13. The spacer 4 is retained in the retaining slot 116 by the blocking portion 43 supported by a bottom wall of the retaining slot 116. The inner PCB 3 is disposed at a rear portion of the base member 11 and sandwiched between the tongue member 12 and the spacer 4.

The tongue plate 122 extends into the mating cavity 13 to divide the mating cavity 13 into a first mating space 131 and a second mating space 132 stacked with the first mating space 131. The top face 124 is defined as a first mating face confronting the first mating space 131, and the bottom face 125 is defined as a second mating face confronting the second mating space 132. The first contacting sections 211 arranged upon the first mating face and disposed in the first mating space 131 are the eSATA connector contacts, the resilient arms 232 arranged upon the second mating face and disposed in the second mating space 132 are the USB 2.0 connector contacts, and the stiff second contacting sections 221 arranged upon the second mating face to cooperate with the resilient arms 232 are the USB 3.0 connector contacts. The five connecting sections 222 electrically connect with the five first soldering legs 212 bending from the two first pairs of differential pairs 21A, 21B and the first grounding contact 21C by the five connecting lines 33, which makes the second contacting sections 221 share corresponding five first soldering legs 212 of the first set of contacts 21 for reducing the exhaustion of the space of the mother PCB and enhancing the rigidity of the mother PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting onto a mother printed circuit board (PCB), comprising:

an insulative housing defining a base portion and a tongue plate forwardly extending into a mating cavity from the base member in a mating direction, the tongue plate defining opposite first and second mating faces in a vertical direction perpendicular to said mating direction;

a first set of contacts retained in the housing and each defining a first contacting section disposed upon the first mating face;

a second set of contacts retained in the housing and each defining a second contacting section disposed upon the second mating face; and an inner PCB retained in the housing and defining at least one input connecting portion, at least one output connecting portion electrically connected with the at least one input connecting portion, and a first soldering leg connecting with the at least one output connecting portion;

wherein at least one contact of the first set of contacts connects with the first soldering leg, and at least one contact of the second set of contacts connects with the at least one input connecting portion so that the at least one contact of the first set of contacts and the at least one contact of the second set of contacts share the first soldering leg for mounting onto the mother PCB.

2. The electrical connector as described in claim 1, wherein the first soldering leg bends from the at least one contact of the first set of contacts to connect with the at least one output connecting portion, and the at least one contact of the second set of contacts electrically connects with the first soldering leg by a connecting line connecting the at least one input connecting portion with the at least one output connecting portion.

3. The electrical connector as described in claim 2, wherein the first set of contacts includes two first pairs of differential pairs for signal transmission, a first grounding contact disposed between the two first differential pairs, and a second and a third grounding contact disposed at two outmost sides thereof, the second set of contacts includes two second pairs of differential pairs for signal transmission and a fourth grounding contact disposed between the two second pairs of differential pairs, the two second pairs of differential pairs and the fourth grounding contact share the first soldering legs respectively bending from the two first pairs of differential pairs and the first grounding contact.

4. The electrical connector as described in claim 3, wherein the inner PCB has seven output connecting portions respectively contacting with the first set of contacts and five input connecting portions respectively contacting with the second set of contacts, and the five input connecting portions respectively electrically connect with the output connecting portions which correspond to the two first pairs of differential pairs and the first grounding contact of the first set of contacts.

5. The electrical connector as described in claim 4, further comprising a third set of contacts retained in the housing, and the third set of contacts each defines a resilient arm arranged upon the second mating face and disposed behind the second contacting sections.

6. The electrical connector as described in claim 5, further comprising a spacer retained in the housing, and the housing includes a base member and a tongue member assembled to the base member, the inner PCB is disposed between the spacer and the tongue member.

7. An electrical connector for mounting onto a mother printed circuit board (PCB), comprising:

an insulative housing defining a base portion and a tongue plate forwardly extending into a mating cavity from the base member in a mating direction, the tongue plate defining opposite first and second mating faces in a vertical direction perpendicular to said mating direction;

an eSATA contact set arranged upon the first mating face and comprising two first pairs of differential pairs and a first grounding contact disposed between the two first pairs of differential pairs;

a second set of contacts arranged upon the second mating face and comprising two second pairs of differential pairs and a fourth grounding contact disposed between the two second pairs of differential pairs;

a third set of contacts arranged upon the second mating face to cooperate with the second set of contacts for performing a USB 3.0 transmission; and an inner PCB retained in the housing and defining input connecting portions, output connecting portions, and first soldering legs electrically connecting to both the input connecting portions and the output connecting portions;

wherein the two first pairs of differential pairs and the first grounding contact respectively connect with the corresponding output connecting portions, and the two second pairs of differential pairs and the fourth grounding contact respectively connect with the corresponding input connecting portions, so that the two first pairs of differential pairs and the first grounding contact of the eSATA contact set share the first soldering legs with the two second pairs of differential pairs and the fourth grounding contact of the second set for mounting onto the mother PCB.

8. The electrical connector as described in claim 7, wherein the first soldering legs each mechanically and electrically connects with corresponding one of the output connecting portions, and electrically connects with corresponding one of the input connecting portions.

9. The electrical connector as described in claim 8, wherein the first soldering legs respectively bend from the corresponding two first pairs of differential pairs and the first grounding contact of the eSATA contact set.

10. The electrical connector as described in claim 7, wherein the housing includes a base member and a tongue member assembled to the base member, and the tongue plate is provided by the tongue member.

11. The electrical connector as described in claim 10, further comprising a spacer retained in the housing, and the inner PCB is disposed between the spacer and the tongue member.

12. The electrical connector as described in claim 10, wherein the second set of contacts are insert molded in the tongue member.

13. A combo electrical connector for mounting to an external printed circuit board, comprising:

an insulative housing defining a commonly mating cavity with a mating tongue extending therein in a plane defined by a front-to-back direction and a transverse direction perpendicular to said front-to-back direction, said mating tongue defining opposite first and second surfaces thereon;

a plurality of first contact disposed in the housing with first contacting sections exposed upon a first surface;

a plurality of second contacts disposed in the housing with second contacting sections exposed upon the second surface; and an internal printed circuit board associated with the housing; wherein an amount of said first contacts and the same amount of said second contacts are electrically and mechanically connected to said internal printed circuit board under condition that a plurality of tails with said same amount are electrical and mechanically connected to the internal printed circuit board for mounting to the external printed circuit board for mutually exclusively transmitting said amount of the first contacts and said amount of the second contacts.

14. The combo electrical connector as claimed in claim 13, wherein said tails with the same amount are unitarily formed with the corresponding first contacts, respectively.

15. The combo electrical connector as claimed in claim 14, wherein said tails extend from the corresponding first contacts and through the internal printed circuit board.

16. The combo electrical connector as claimed in claim 13, wherein both the first contacting sections and the second contacting sections are immovable during mating.

17. The combo electrical connector as claimed in claim 16, further including a plurality of third contacts with third contacting sections exposed upon the second surface, wherein said third contacting sections are deflectable during mating.

18. The combo electrical connector as claimed in claim 17, wherein tails of said third contacts directly extend with involvement with the internal printed circuit board for mounting to the external printed circuit board.

19. The combo electrical connector as claimed in claim 13, wherein the mating tongue is discrete from a base of the housing, and the base of the housing and said mating tongue are configured and dimensioned to allow the mating tongue only to be forwardly inserted into the mating cavity in said front-to-back direction.

20. The combo electrical connector as claimed in claim 19, wherein said internal printed circuit board defines through hole into which tails of the first contacts extend, and a space is located under the internal printed circuit board to regulate the tails of the first contacts.

* * * * *